US005373679A

United States Patent [19]

Goleby

[11] Patent Number: 5,373,679

[45] Date of Patent: Dec. 20, 1994

[54] STRUCTURAL MEMBER AND PROCESS FOR FORMING SAME

[75] Inventor: Leslie D. Goleby, Brisbane, Australia

[73] Assignee: Tube Technology Pty Ltd, Queensland, Australia

[21] Appl. No.: 103,325

[22] Filed: Aug. 9, 1993

Related U.S. Application Data

[60] Continuation of Ser. No. 923,578, Aug. 3, 1992, abandoned, which is a division of Ser. No. 875,610, Apr. 28, 1992, Pat. No. 5,163,225, which is a continuation of Ser. No. 762,174, Sep. 20, 1991, abandoned, which is a continuation of Ser. No. 459,713, Dec. 14, 1989, abandoned.

[30] Foreign Application Priority Data

| | | | |
|---|---|---|---|
| Jul. 25, 1988 | [AU] | Australia | PI9427 |
| Nov. 18, 1988 | [AU] | Australia | PJ1534 |
| Jul. 27, 1989 | [WO] | WIPO | PCT/AU89/00313 |

[51] Int. Cl.[5] ..... E04C 3/30

[52] U.S. Cl. ..... 52/729; 52/720; 52/731.1; 52/731.7

[58] Field of Search ..... 29/897.35, 897.34, 897.33, 29/897.3, 897; 52/729, 720, 364, 731.1, 731.7, 731.8; 228/173.4, 173.6, 173.7, 146, 147; 219/61.2, 61.3, 8.5

[56] References Cited

U.S. PATENT DOCUMENTS

| | | | |
|---|---|---|---|
| D. 27,394 | 7/1897 | Horton . | |
| D. 28,864 | 6/1898 | Baker . | |
| D. 32,294 | 2/1900 | Bissell . | |
| 195,207 | 2/1877 | De Buigne . | |
| 426,558 | 4/1890 | Dithridge | 52/720 |
| 991,603 | 5/1911 | Brooks | 52/364 |
| 1,377,251 | 5/1921 | Hunker . | |
| 1,454,659 | 5/1923 | Thurston . | |
| 2,127,618 | 8/1938 | Riemenschneider . | |
| 3,140,764 | 7/1964 | Cheskin . | |
| 3,199,174 | 8/1965 | Nilsson et al. . | |
| 3,241,285 | 3/1966 | Baroni . | |

(List continued on next page.)

FOREIGN PATENT DOCUMENTS

| | | |
|---|---|---|
| 59988/69 | 3/1971 | Australia . |
| 61568 | 8/1973 | Australia . |
| 68793 | 3/1977 | Australia . |
| 81033 | 5/1981 | Australia . |
| 81034 | 5/1981 | Australia . |

(List continued on next page.)

OTHER PUBLICATIONS

Russian Text Reference–"Prestressed Steel Structures", Ferentschik et al., 1979 How HF Forge Welding Works For You, Welded Beam Corp.

(List continued on next page.)

*Primary Examiner*—Mark Rosenbaum
*Assistant Examiner*—David P. Bryant
*Attorney, Agent, or Firm*—Nixon & Vanderhye

[57] ABSTRACT

A structural member which comprises a pair of hollow end sections and an intermediate web characterized in that each hollow end section is welded to the intermediate web so as to form two weld lines or joins extending along the structural member. Suitably the intermediate web is predominantly planar and the structural member is formed from a unitary sheet of metal having opposed edges whereby a respective edge is located adjacent said intermediate web and is welded thereto to form said weld lines or weld joins.

The invention also includes within its scope a process for forming the structural member including the following steps:

(i) passing substantially planar metal strip through a plurality of forming stations to successively deform opposed free edges of the metal strip so as to provide a pair of substantially hollow end sections wherein a respective free edge is located adjacent to an intermediate web interposed between each substantially hollow end section; and (ii) welding the respective free edge to the intermediate web to form two weld lines or joins extending along the structural member.

9 Claims, 12 Drawing Sheets

U.S. PATENT DOCUMENTS

| | | | |
|---|---|---|---|
| 3,256,670 | 6/1966 | Tersigni . | |
| 3,342,007 | 9/1967 | Merson | 52/729 |
| 3,434,198 | 3/1969 | Bergantini . | |
| 3,452,433 | 7/1969 | Scofield . | |
| 3,517,474 | 6/1970 | Lanternier . | |
| 3,713,205 | 1/1973 | Wogerbauer . | |
| 3,735,547 | 5/1973 | Moyer et al. . | |
| 3,827,117 | 8/1974 | Oilman . | |
| 3,860,781 | 1/1975 | Aschauer . | |
| 4,002,000 | 1/1977 | Howard et al. . | |
| 4,402,206 | 9/1983 | Yanazawa et al. . | |
| 4,433,565 | 2/1984 | Preller . | |
| 4,468,946 | 9/1984 | Driear . | |
| 4,586,646 | 5/1986 | Booher . | |
| 4,750,663 | 6/1988 | Warczak . | |

FOREIGN PATENT DOCUMENTS

| | | | |
|---|---|---|---|
| 80609 | 6/1981 | Australia . | |
| 83893 | 11/1981 | Australia . | |
| 82833 | 7/1982 | Australia . | |
| 84401 | 8/1982 | Australia . | |
| 107513 | 6/1967 | Denmark . | |
| 0132894 | 2/1985 | European Pat. Off. . | |
| 267843 | 5/1988 | European Pat. Off. | 29/897.35 |
| 2374977 | 7/1978 | France . | |
| 2549933 | 2/1985 | France . | |
| 812600 | 9/1951 | Germany | 52/720 |
| 1023210 | 1/1958 | Germany . | |
| 3319745A1 | 12/1984 | Germany . | |
| 131211 | 1/1975 | Norway . | |
| 444464 | 4/1986 | Sweden . | |
| 8504948 | 4/1987 | Sweden . | |
| 1575742 | 9/1920 | United Kingdom . | |
| 2093886A | 9/1982 | United Kingdom . | |
| 2102465A | 2/1983 | United Kingdom . | |
| 2145145A | 3/1985 | United Kingdom . | |
| 245935 | 10/1967 | U.S.S.R. . | |
| 827723 | 5/1981 | U.S.S.R. | 52/729 |
| 872690 | 10/1981 | U.S.S.R. . | |
| 968251 | 10/1982 | U.S.S.R. . | |
| 1026997A | 7/1983 | U.S.S.R. . | |

OTHER PUBLICATIONS

Derwent Abstract Accession No. B7412 E/07, SU-82-7-723, May 22, 1981.

Derwent Abstract Accession No. 87-161194/23, SE 8504-948-A, Apr. 22, 1987.

Patent Abstracts of Japan, M8, p. 120, JP 55-22443 (A), dated Feb. 18, 1980, "Production of Frame Material", assigned to National Jiyuutaki Kenzai K.K.

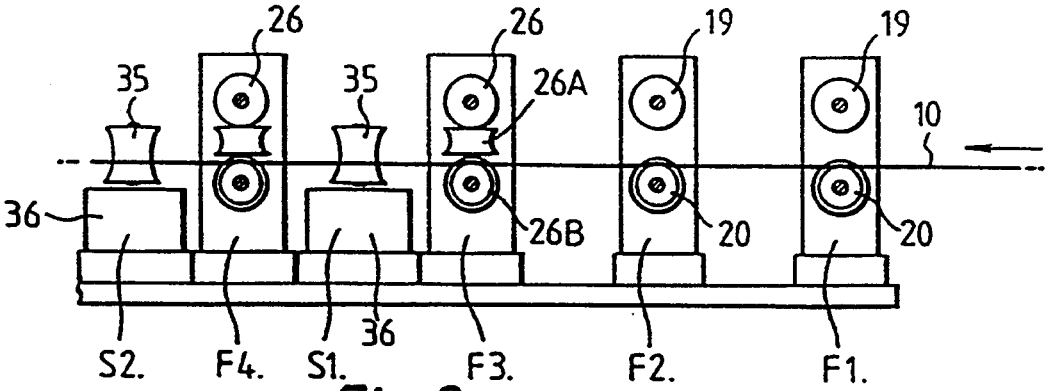
Fig.2.
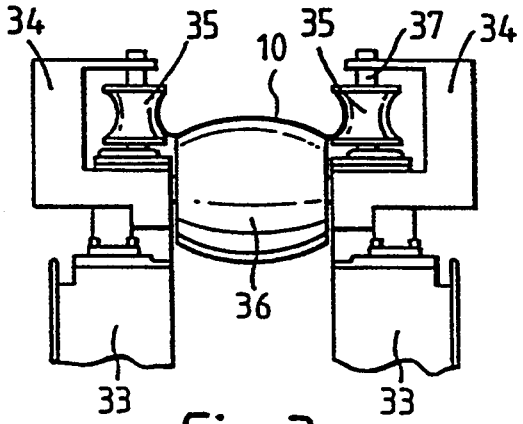
Fig.3.
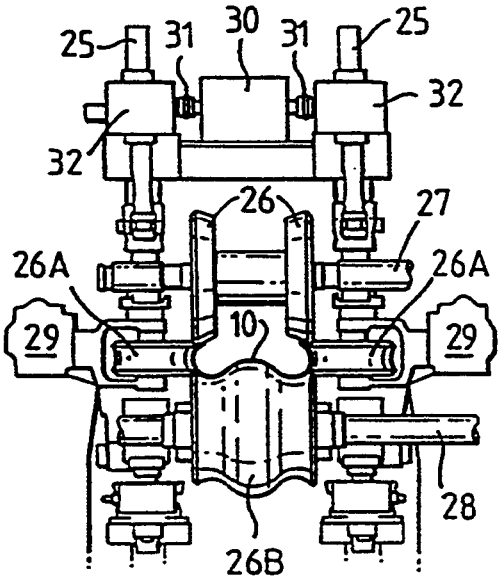
Fig.4.
Fig.5.
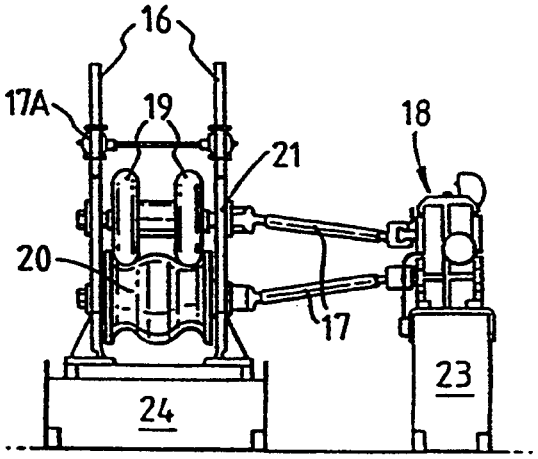

STRUCTURAL MEMBER AND PROCESS FOR FORMING SAME

This is a continuation of application Ser. No. 07/923,578 filed Aug. 3, 1992 and now abandoned, which in turn is a division of application Ser. No. 07/875,610 filed Apr. 28, 1992, now U.S. Pat. No. 5,163,225, which is a continuation of application Ser. No. 07/762,174 filed Sep. 20, 1991 and now abandoned, and which is a continuation of application Ser. No. 07/459,713 filed Dec. 14, 1989, and now abandoned.

Non hollow or solid structural members such as I-beams, rolled steel joists (RSJ's) purlins and girts which are all used for structural purposes in buildings such as factories, houses and office buildings have been found to be normally satisfactory in use and have a basic cross sectional shape or profile which is very efficient in resisting bending movement. These conventional structural members or beams are normally formed from hot rolling processes.

However, such conventional solid structural members or universal beams which are generally formed from hot rolling processes generally comprise two parallel flanges and a single flat or planar web wherein the flanges are substantially thicker than the web. Such conventional solid structural members have certain disadvantages and these include the following:

(i) exposed surface area to mass and strength ratios are high which lead to increased costs for both corrosion protection and fire proofing;

(ii) flange widths to thickness ratios are generally limited to avoid reductions in load bearing section capacity due to local buckling considerations;

(iii) web widths to thickness ratios are generally limited to avoid reductions in section load bearing capacity due to local buckling considerations;

(iv) the hot rolling method of manufacture leads to production of substantial mill scale and rust as well as providing a limited minimum thickness; and (v) prime painting during manufacture is not a practical proposition.

There also have been used cold rolled structural members which include purlins and rectangular hollow sections and these are subject to certain disadvantages as described below.

In particular purlin sections which are generally of C or Z shape have flange widths to thickness ratios and web width to thickness ratios which are severely limited by local buckling considerations.

Rectangular hollow sections (RHS) have also been proposed as structural members wherein each wall of the rectangle was of substantially the same thickness. However, these conventional structural members were inefficient in regard to bending movement considerations and wall widths to thickness ratios were generally limited to avoid reductions in load bearing capacity due to local buckling considerations.

Structural members have also been proposed including a pair of hollow end sections which are separated by an intermediate web. Thus, for example, in U.S. Pat. No. 3,342,007 to Merson, a structural member was proposed which was manufactured from a single piece of steel sheet by cold roll forming wherein there was provided triangular hollow end sections separated by a planar web. Each triangular hollow end section included a horizontal side or flange and a pair of sloping sides or flanges and the free ends of the single piece of steel sheet were comprised of ends of each of the sloping flanges which abutted the other adjacent sloping flange.

In addition the structural members described in both the abovedescribed Merson and Lanternier specifications had markedly reduced load bearing capacities for concentrated loads.

U.S. Pat. No. 3,517,474 to Lanternier also described a flanged structural assembly including a pair of hollow end sections which were rectangular or trapezoidal and an intermediate planar web. The hollow end section and the web were all separate components and the web was welded to the hollow end sections. Each end section included a pair of free ends or edges which were bent or folded and which converged to the middle part of a top flange or wall of the hollow end sections.

U.S. Pat. No. 426,558 to Ditheridge also described a structural member having a pair of hollow end sections and an intermediate planar web which was of an integral construction. Although no method of manufacture is described it would seem that Ditheridge refers to wrought steel or iron beams or sills which are formed in a mould.

However, in regard to the structural members described in the abovementioned U.S. Patents it was considered that these structural members would have markedly reduced load capacities due to local buckling considerations. This would seem to be the case especially of U.S. Pat. No. 3,342,007 to Merson wherein the free ends of the single piece of steel sheet comprising one end of each sloping flange abutted the other sloping flange. This would also have applied to Lanternier.

The flanged structural assembly of Lanternier in not being formed from a single piece of metal strip would also have been relatively expensive to produce because it was formed from three components. Also the manufacturing step of folding the free edges of each rectangular or hollow end section as described above would seem to complicate manufacture and increase the cost thereof.

It is therefore an object of the present invention to provide a structural member and a method of manufacture of same that alleviates the abovementioned disadvantages associated with the prior art.

In one broad form, this invention provides an elongate structure member formed from a single strip of metal by a continuous cold rolling process, the structural member comprising an intermediate web member and hollow flanges extending longitudinally of the intermediate web member; characterised in that the hollow flange are of a predetermined shape and are formed by successively deforming free edge portions of a planar strip of metal in a roll forming mill in a continuous operation followed by continuous seam welding of the respective free edges of the shaped hollow flange portions to the surface of the intermediate web member adjacent the junction of the web member and respective hollow flange portions; and the free edges of the hollow flange portions are welded to the surface of the intermediate web member by high frequency electrical induction or resistance welding.

The hollow flanges may be of any suitable shape and thus may be circular, rectangular, triangular or polygonal. It is also not necessary that each hollow flange have a similar shape so that it is within the scope of the invention to have differently shaped hollow flange sections at each longitudinal side of the structural member.

While it is preferred that each hollow flange be substantially of the same size this is not strictly essential and thus it is possible, having regard to the scope of the invention, that the hollow flanges be different in size as well as shape.

Reference may also be made to a process for forming the abovementioned structural member which may include the following steps:

(i) passing substantially planar metal strip through a plurality of forming stations to successively deform opposed free edges of the metal strip so as to provide a pair of substantially hollow end sections wherein a respective free edge is located adjacent to an intermediate web interposed between each substantially hollow end section; and (ii) welding the respective free edge to the intermediate web, preferably perpendicularly thereto, to form the weld lines or joins extending along the structural member.

In the process of the invention it is possible to initially subject the substantially planar metal strip to preforming operations wherein ancillary or additional structural features or embellishments may be imparted to the metal strip. These ancillary features include perforations, grooves, dimples, corrugations, protrusions and the like which may be considered appropriate having regard to the end use of the structural member or to increase load bearing capacity of the structural member.

The ancillary structural features made at the preforming stage may be either essentially unchanged or slightly or substantially modified by any subsequent forming operations. Thus if desired, further ancillary structural features or embellishments may be imparted to the structural member of the invention after or during the forming operations.

In step (i) of the process of the invention the substantially planar metal strip may be successively deformed through a number of roll forming stations. Preferably each free edge portion may be successively or sequentially deformed so that the cross sectional profile of the metal strip is substantially W shaped after it passes through the forming stations. This is shown in detail in the drawings hereinafter. However, it will also be appreciated that other roll forming cross sectional profiles may be utilized such as for example the free edge portions of the metal strip being bent inwardly through a number of different passes so as to form a substantially triangular hollow end section. This is also shown in the drawings hereinafter.

It is also possible in regard to the forming step that the desired end profile of the structural member be formed directly after passage of the metal strip through the final forming station. However, it is also within the ambit of the invention that a basic shape e.g. two separate circles separated by a single web be formed after passage through the final forming station which is then subsequently subjected to further shaping procedures to produce a number of different cross sectional profiles. Another possible alternative is to produce the basic shape of two separate circles separated by a single web using different roll passes and then subjecting the basic shape to further shaping operations to produce a variety of cross sectional profiles.

In regard to the forming step (i) it is preferred to pass the metal strip through a plurality of cold roll forming stations. However, it is also possible to produce the structural member of the invention by other forming methods such as press braking or extrusion processes.

After the forming step the strip or workpiece may be passed to a welding station. The welding method may be high frequency induction or electrical resistance welding.

Of the above it is preferred, having regard to the process of the invention, to use high frequency induction welding.

In this type of welding a high frequency alternating current is used to induce currents in the areas requiring welding so that opposing weld join areas (e.g. a free edge of the strip abutting the intermediate web or being located closely adjacent thereto) at two separate locations are heated to a point where the weld rolls are able to forge weld the strip to form the desired cross sectional profile.

At the welding station it is also within the scope of the process of the invention to apply one or more scarfing operations to the workpiece whereby weld projections or excess weld bead may be removed. As an alternative to scarfing to remove excess weld bead there also may be used weld bead flattening.

Finally and if desired the workpiece or metal strip may be passed to a straightening and/or shaping station wherein shaping rolls mounted in a number of cold forming roll stands are used to produce the desired cross sectional profile. The shaping rolls may successively deform the welded section. However, it is possible to avoid the use of shaping rolls by direct forming the workpiece so that after passing through the welding station it is already in the desired final shape. In this case however straightening may be an integral part of the direct forming process.

Reference may now be made to a preferred embodiment of the invention as shown in the attached drawings wherein:

BRIEF DESCRIPTION OF THE DRAWINGS

FIG. 2 is a side elevation of the forming section;

FIG. 3 is end view of rolls S1–S2 shown in FIG. 2;

FIG. 4 is an end view of rolls F1–F2 shown in FIG. 2;

FIG. 5 is an end view of rolls F3–F4 shown in FIG. 2;

FIGS. 37, 38 and 39 illustrate a structural member of the invention prestressed by appropriate means, wherein FIG. 38 is a section along line B—B of FIG. 37.

In FIG. 1 there is shown flat metal strip 10 being passed through a forming section 11 having forming rolls F1, F2, F3 and F4 as well as side rolls S1 and S2. There is also shown edge preparation and welding section 12 having rolls EP1, EP2 and WP1. Also shown is welder 13. Finally there is shown shaping and straightening section 14 having shaping rolls SH1, SH2, SH3 and SH4 and straightening rolls ST1. Also shown is structural member 15' having the desired cross sectional profile in accordance with the invention.

In FIGS. 2–5 the shaping rolls F1–F2 as best shown in FIG. 5 include adjusting screws or screw jacks 16, drive shafts 17 and drive unit 18. Also shown are upper rolls 19 and lower roll 20. Upper rolls 19 are each vertically adjustable by movement along adjusting screws 16. Also shown are bearing housings 21. Support stands 23 and 24 are also shown. Movement of rolls 19 along screw jacks 16 are caused by manual actuation of adjustment mechanisms 17A.

Figure 1:
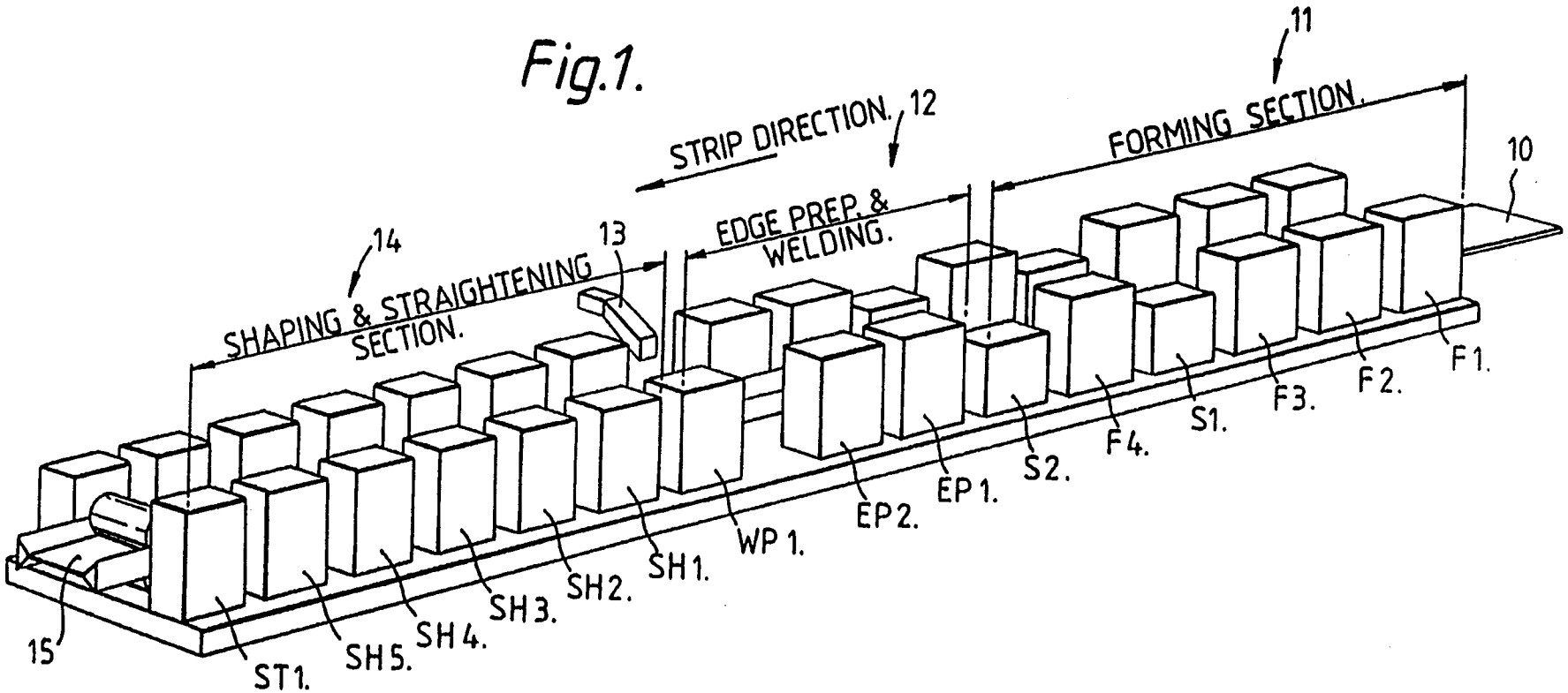
FIG. 1 is a schematic view of apparatus used in the process of the invention including a forming section, edge preparation and welding section and a shaping and straightening section.

The forming rolls F3–F4 as best shown in FIG. 4 include adjusting screws or screw jacks 25 for top rolls 26. Shafts 27–28 are connected to a drive unit such as drive unit 18 shown in FIG. 5. There is also shown side rolls 26A and lower roll 26B. Horizontal adjustments of side rolls 26A relative to workpiece 10 are caused by adjusters 29. There is also indicated direct coupling 30 and connection shafts 31 which engage with gearboxes 32 to move the top roll 26 along screw jacks 25 in unison.

Actuation of vertical movement of rolls 26 is caused by manual adjustment wherein actuating spindle 32A is rotated by appropriate means.

The side rolls S1–S2 as best shown in FIG. 3 include roll stands 33, bearing housings 34, vertical oriented rolls 35, lower roll 36 and roll shafts 37.

Figure 6:
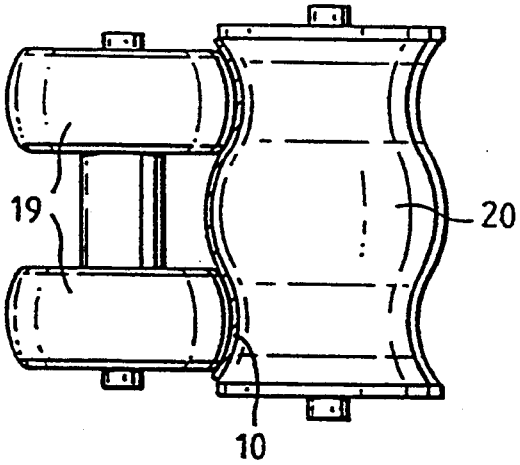
FIG. 6 illustrates a typical set of rolls F1.
Figure 7:
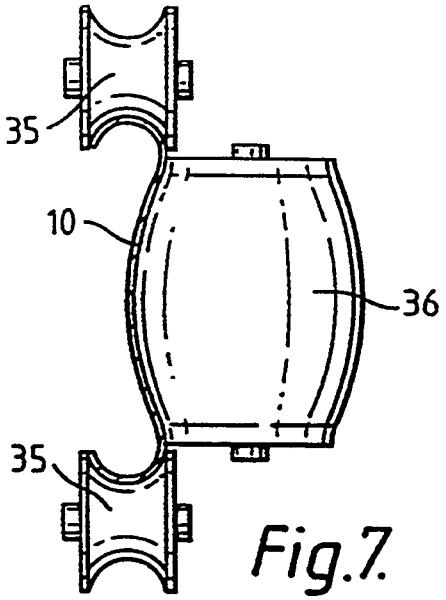
FIG. 7 illustrates a typical set of rolls S1.
Figure 8:
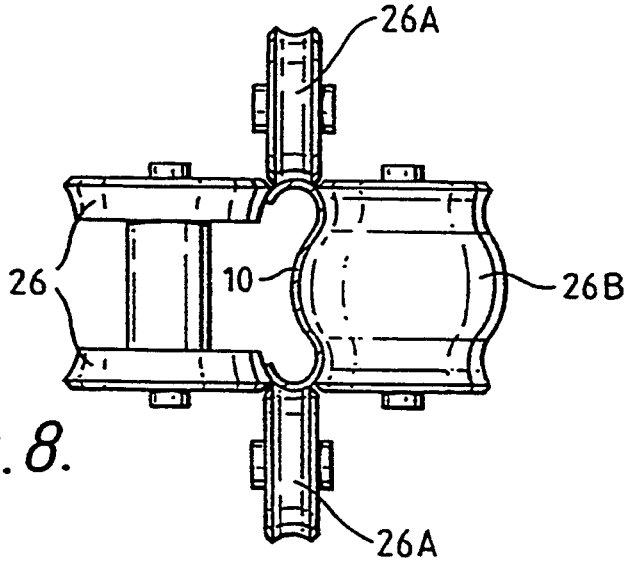
FIG. 8 illustrates a typical set of rolls F4.
Figure 9:
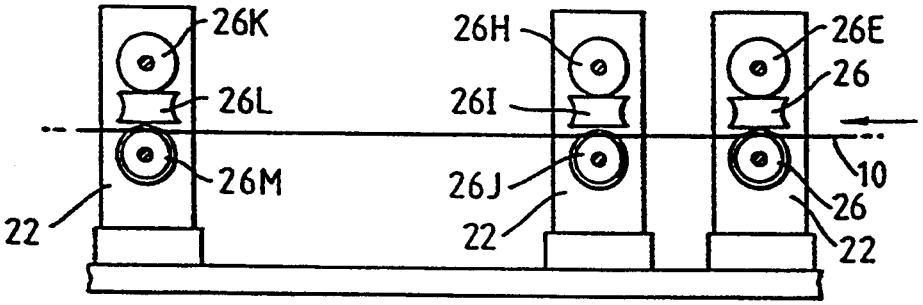
FIG. 9 illustrates a side view of the edge preparation and welding section.

FIG. 6–8 show sequentially the formation of strip 10 and the development of the desired W cross sectional profile. The side edges of strip 10 are gradually bent inwardly as shown by the action of rolls 19 and 20 in FIG. 6, rolls 35 and 36 in FIG. 7 and rolls 26A, 26B and 26 in FIG. 8.

Figure 8A:
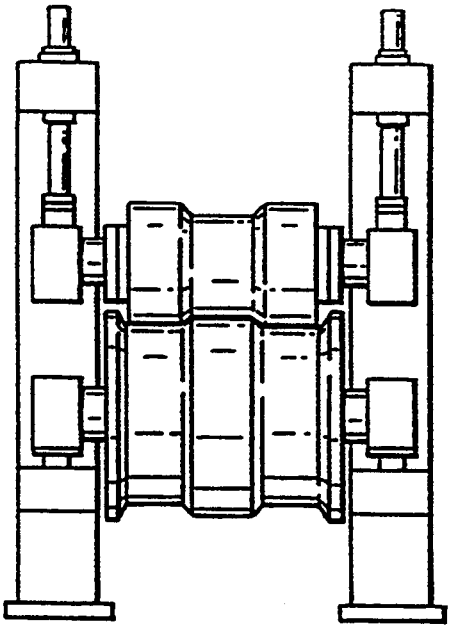
FIG. 8A illustrates another typical set of rolls F1 or F2.
Figure 8B:
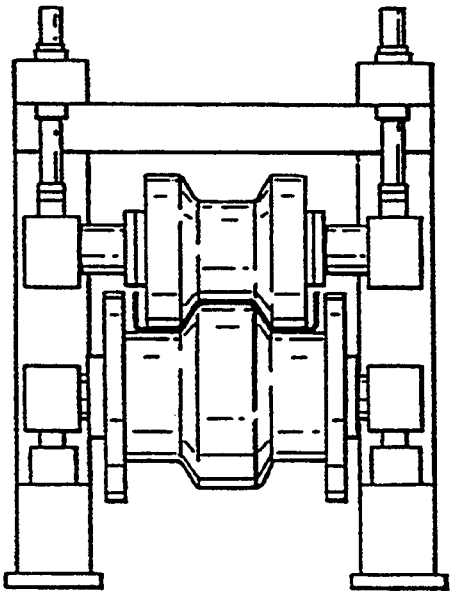
FIG. 8B illustrates another typical set of rolls F3 or F4.
Figure 8C:
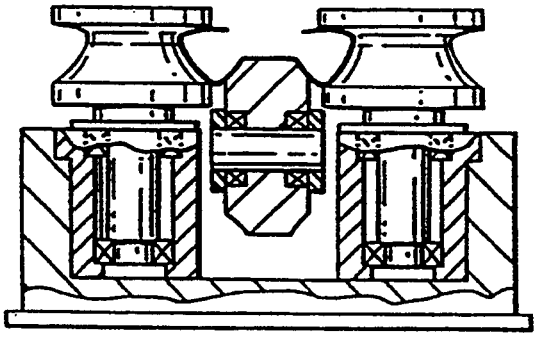
FIG. 8C illustrates another typical set of rolls S1 or S2.
Figure 26:
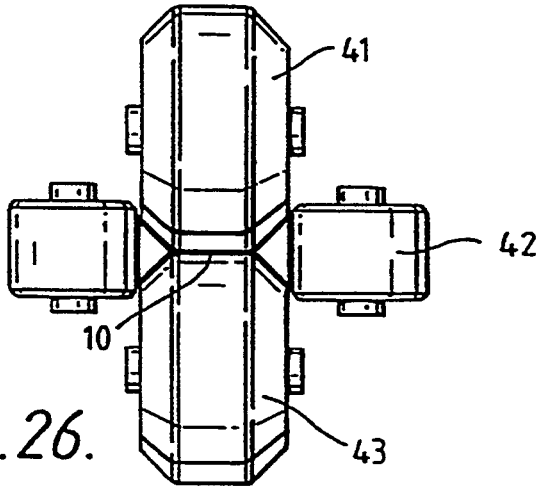
FIG. 26 illustrates an end view of rolls SH5.

In FIGS. 8A, 8B and 8C there is shown a modified sequence of shapes that are applicable to rolls F1 and F2, F3 and F4 and S1 and S2 respectively. Similar reference numerals are used as in FIGS. 3, 4 and 5 with the-exception that rolls 19A and 20 in FIG. 8A, rolls 26V and 26W in FIG. 8B and rolls 35A and 36A have a different profile to the corresponding rolls 19 and 20 in FIG. 5, 26 and 26B in FIG. 4 and 35 and 36 in FIG. 3.

FIGS. 9–12 show the edge preparation and welding section wherein strip 10 passes sequentially through rolls EP1, EP2 and WP1.

Figure 10:
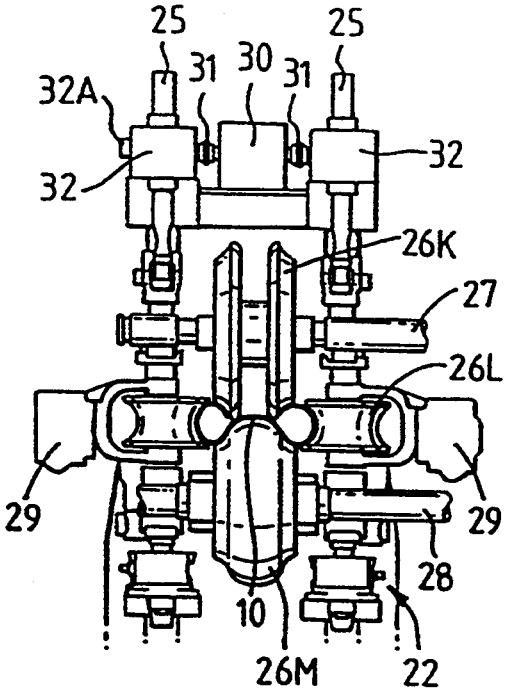
FIG. 10 illustrates an end view of rolls WP1.
Figure 11:
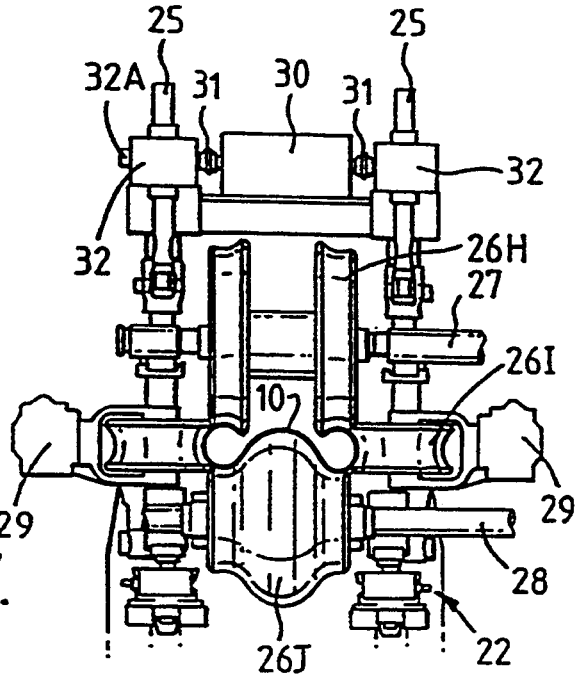
FIG. 11 illustrates an end view of rolls WP2.
Figure 12:
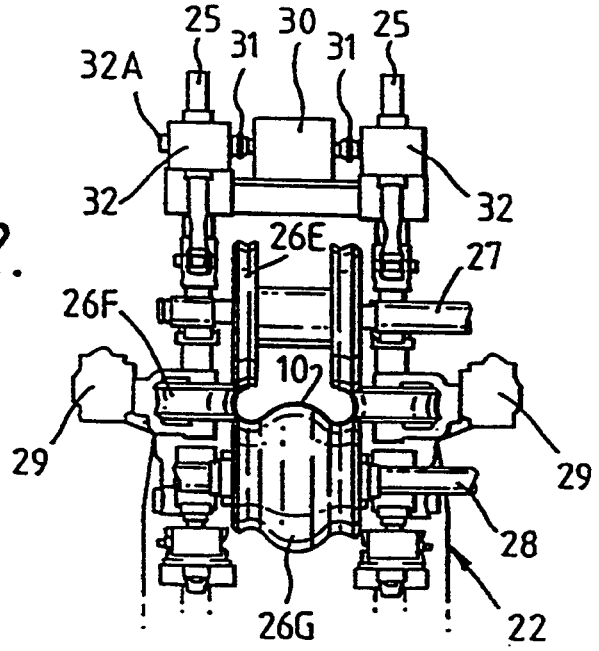
FIG. 12 illustrates an end view of rolls

FIGS. 10–12 show rolls WP1, EP2 and EP1 which are all very similar in structure to rolls F3–F4 described in FIG. 4 and hence similar reference numerals are shown. However the top rolls of FIGS. 10, 11 and 12 are designated 26K, 26H and 26E respectively, the side rolls 26L, 26I and 26F and the bottom rolls are designated 26M, 26J and 26G. Each of rolls WP1, EP2 and EP1 are supported on roll stands 22.

Figure 13:
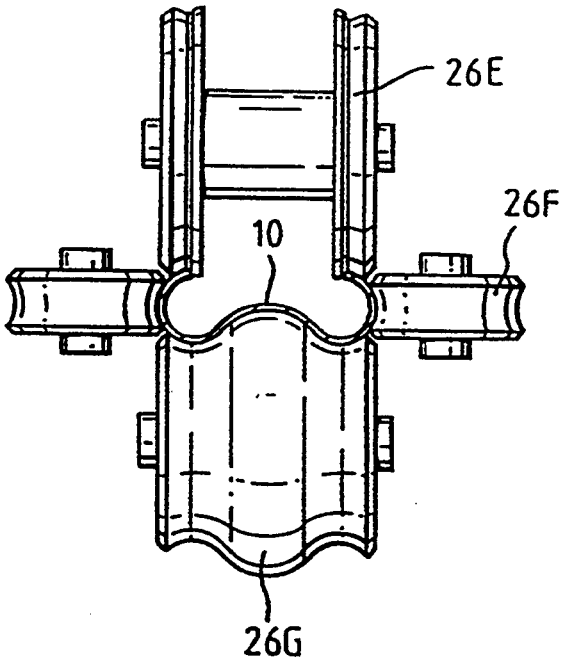
FIG. 13 illustrates a typical set of rolls WP1.
Figure 14:
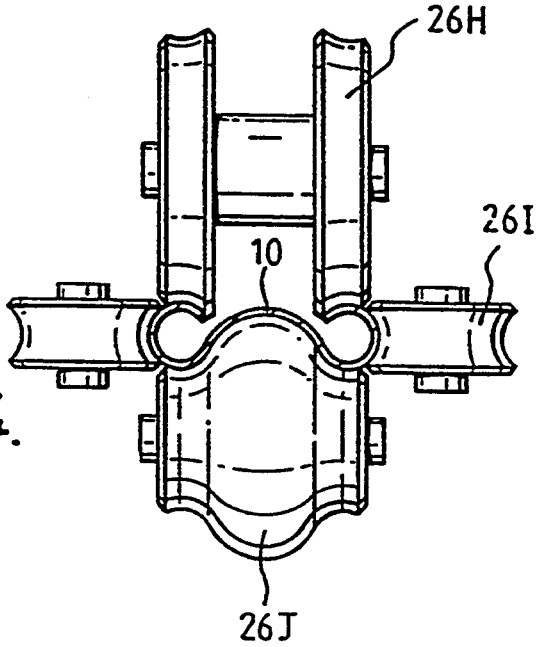
FIG. 14 illustrates a typical set of rolls EP2.
Figure 15:
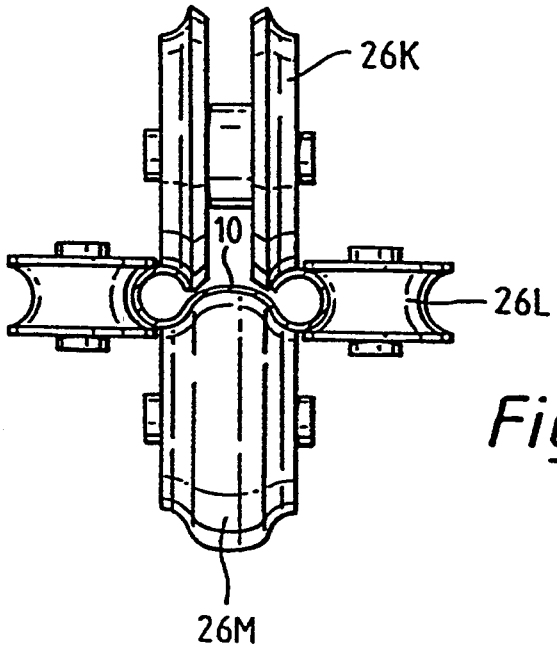
FIG. 15 illustrates a typical set of rolls EP1.

FIGS. 13–15 also show sequentially the development of the cross sectional profile of strip 10 after passing through rolls EP1, EP2 and WP1. The formation of the desired circular hollow end sections are shown from the W profile shown in FIG. 13.

Figure 16:
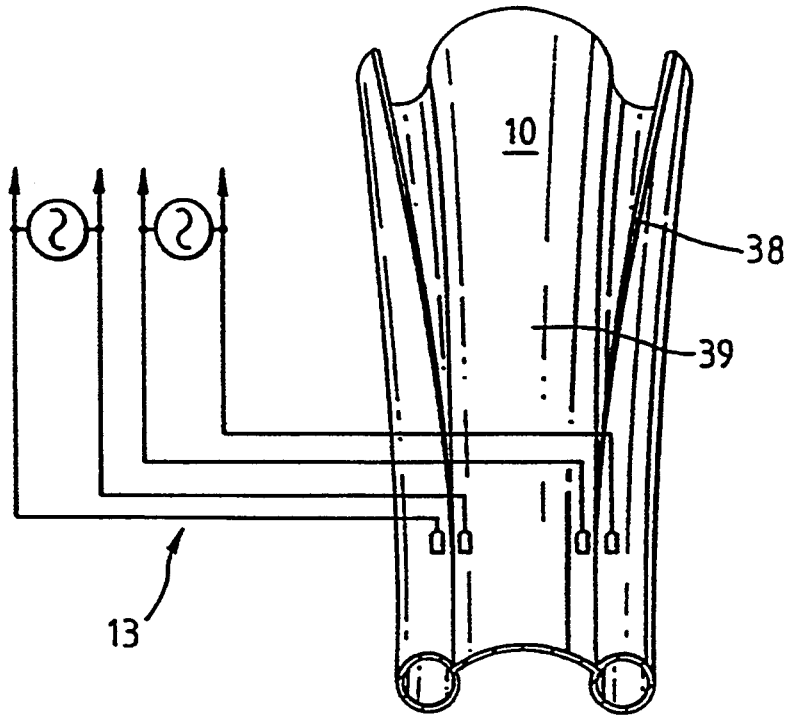
FIGS. 16, 17 and 18 illustrate alternative views of the welding section showing welding apparatus (FIG. 16), welding rolls (FIG. 17), and scarfing apparatus (FIG. 18)
Figure 17:
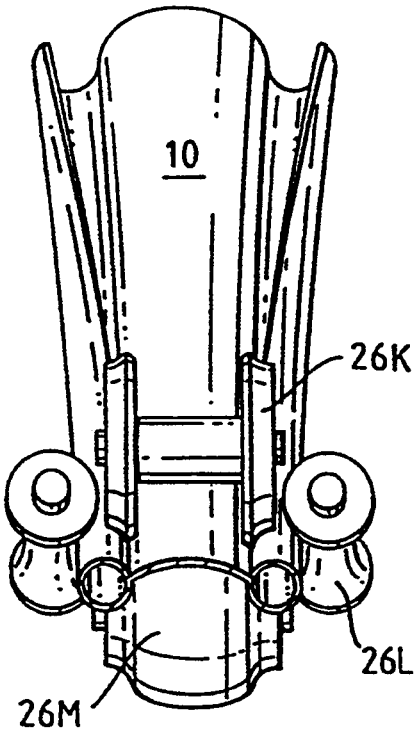
Figure 18:
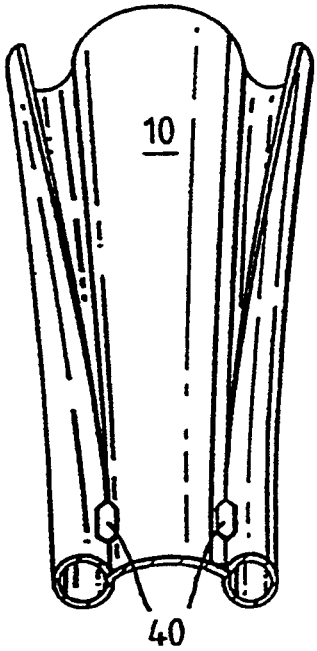

In FIGS. 16–18 are shown welding apparatus used in the invention and this includes a high frequency welder 13 having welding contacts Aa, Ab, Ba and Bb which contact each free edge 38 of strip 10 and web part 39 as shown.

During use of high frequency welder 13 the parts 38 and 39 of strip 10 are forced into abutment. However, it is emphasized that if using of other welding means such as TIG or MIG, parts 38 and 39 do not have to abut but be spaced closely apart.

FIG. 17 shows the operation of the rolls of roll assembly WP1 in producing the desired abutment of parts 38 and 39.

FIG. 18 shows the operation of scarfing means 40 to remove excess weld bead as discussed above.

Figure 19:
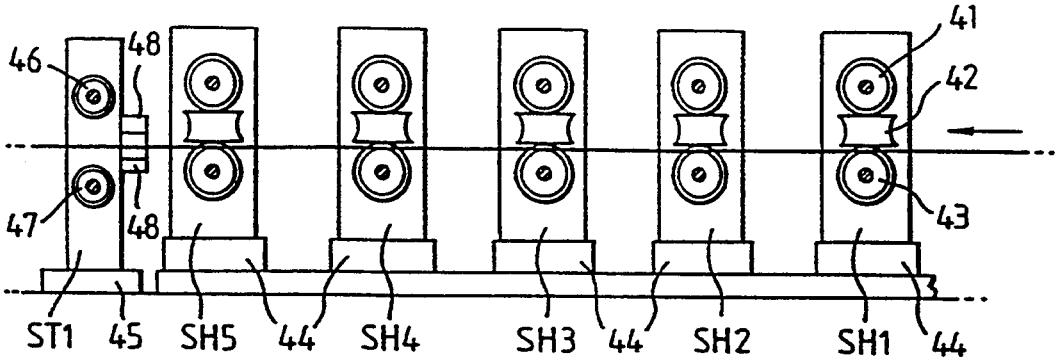
FIG. 19 illustrates a side view of the shaping and straightening section.
Figure 20:
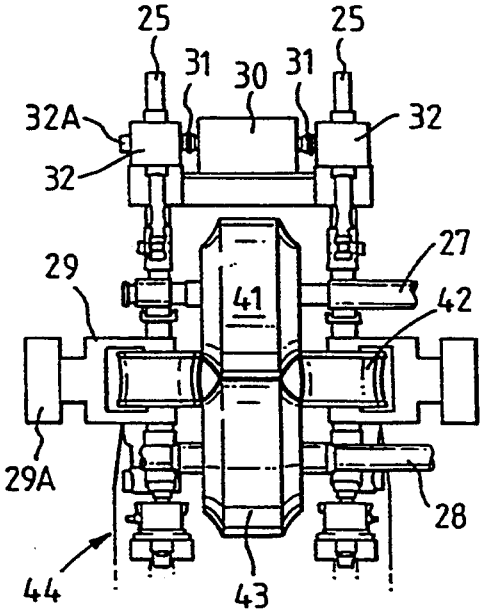
FIG. 20 illustrates a typical set of rolls designated as SH3.
Figure 21:
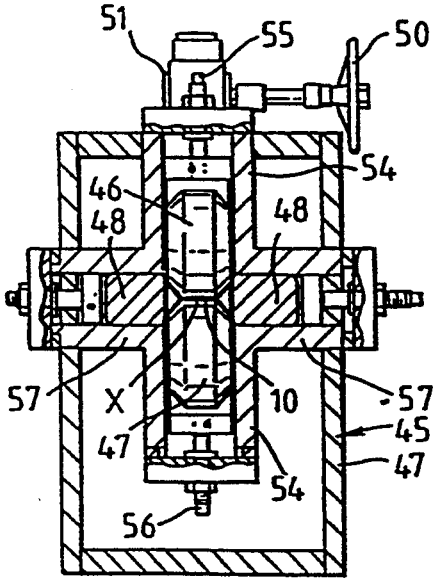
FIG. 21 illustrates a typical set of rolls designated as SH1.

FIGS. 19–21 show the operation of shaping rolls SH1, SH2, SH3, SH4 and SH5 and straightening rolls ST1.

The operation of a typical shaping roll is best shown in FIG. 20 and this is very similar to the operation of forming rolls F3, F4 as described above, hence similar reference numerals have been utilized. The top roll has bene designated however 41, side rolls 42 and bottom rolls 43. All the rolls are supported on roll stands 44.

The operation of the straightening roll assembly ST1 is best shown in FIG. 21 and this includes roll housing 45. There are provided a pair of top and bottom rolls 46–47 and a pair of side rolls 48. The entire assembly 49 of rolls 46, 47 and 48 may be pivoted about a centre axis designated by X in the plane of the drawing by actuation of handle 50 which engages in gearbox 51. There are also provided adjusters 52 and 53 for vertical adjustment movement of rolls 46 and 47 in supporting slides 54 relative to workpiece 10. There is also provided adjusters 55 and 56 for horizontal adjustment movement of side rolls 48 relative to workpiece 10 in supporting slides 57.

Figure 22:
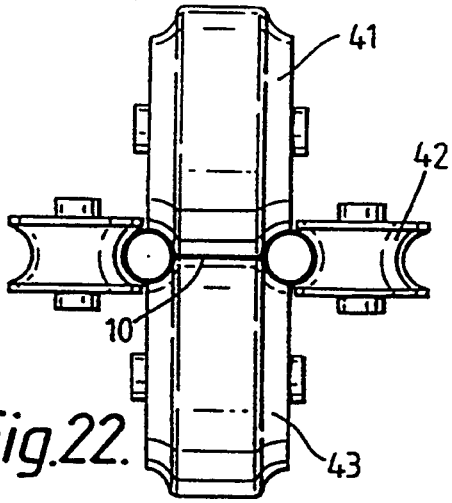
FIG. 22 illustrates an end view of rolls SH1.
Figure 23:
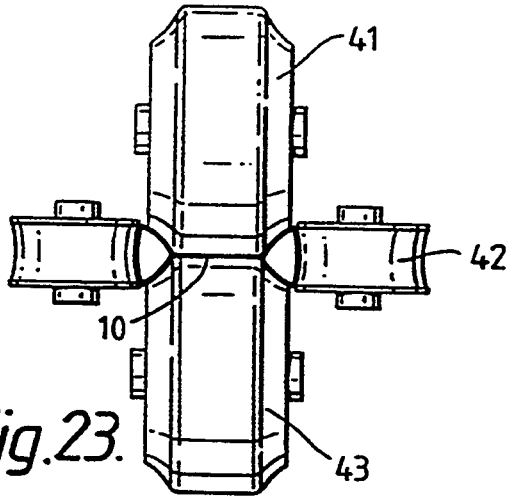
FIG. 23 illustrates an end view of rolls SH2.
Figure 24:
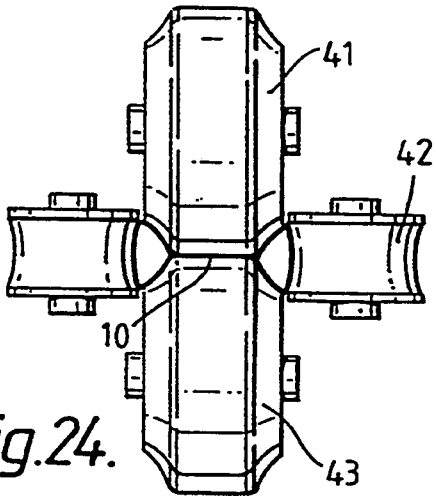
FIG. 24 illustrates an end view of rolls SH3.
Figure 25:
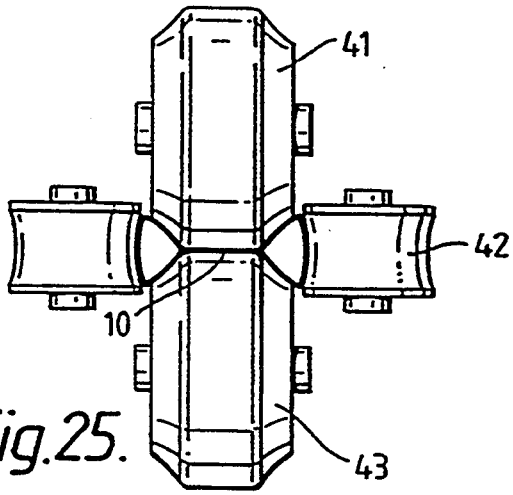
FIG. 25 illustrates an end view of rolls SH4.

The sequential series of events which now take place in regard to the workpiece 10 are shown in FIGS. 22–26 which demonstrate that a workpiece 10 having a cross sectional profile as best shown in FIG. 22 may be converted sequentially into a number of other shapes as shown in FIGS. 23, 24, 25 or 26 to finally produce triangular hollow end sections.

Figure 28A:
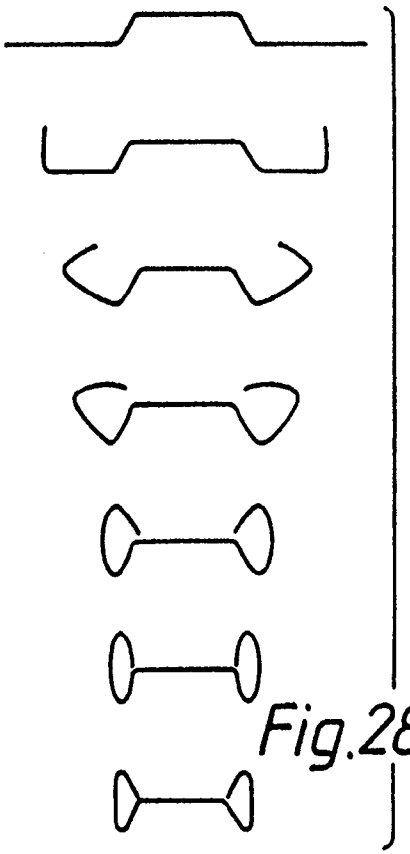
FIGS. 27, 28 and 28A illustrate alternative flower sections that may be obtained in the forming step.
Figure 28:
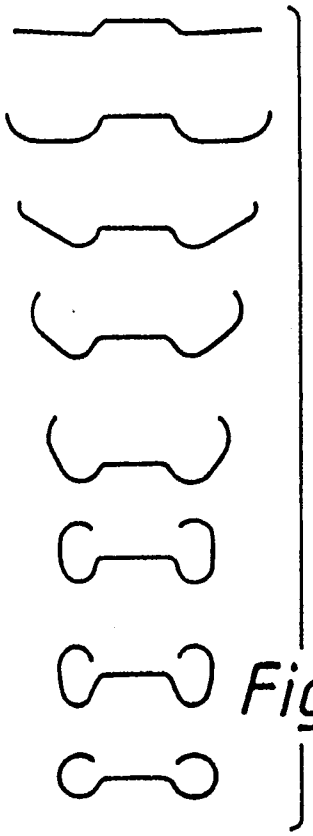
Figure 27:
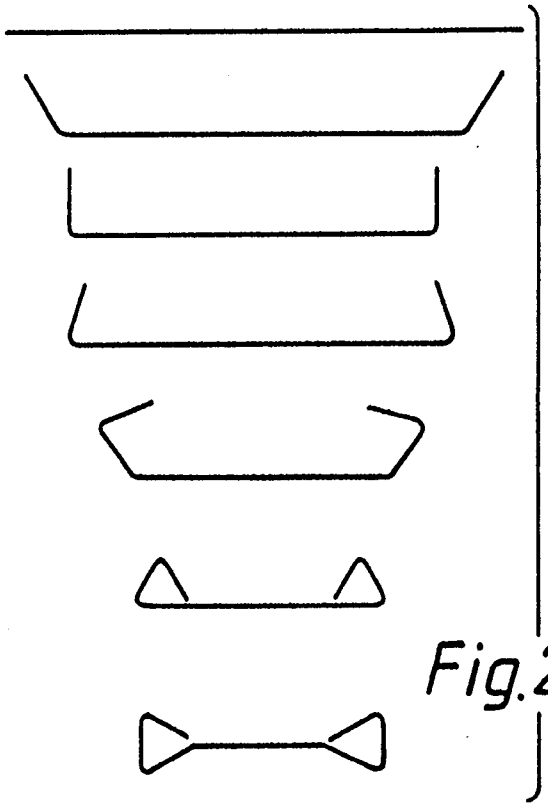

Alternative roll formed sections that may be produced during the process of the invention are shown in FIGS. 27, 28 and 28A. FIG. 27 illustrates a profile obtained wherein the web remains primarily planar during the forming process. On the other hand FIGS. 28 and 28A show that this is not essential and that other shapes may be obtained such as sequential bending of the free edges of the strip inwardly or back upon themselves to produce triangular hollow end sections.

Figure 29:
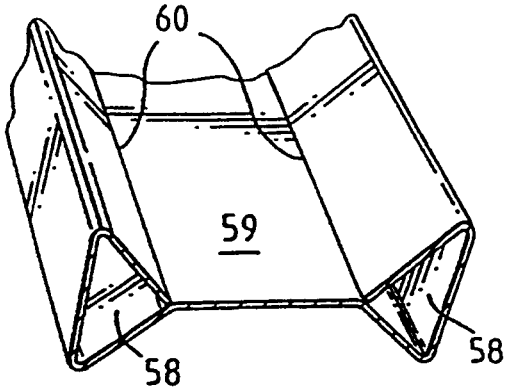
FIGS. 29–35 illustrate alternative cross sectional profiles that may be obtained in accordance with the invention.
Figure 30:
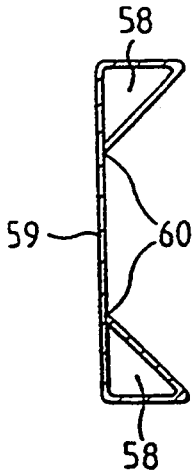
Figure 31:
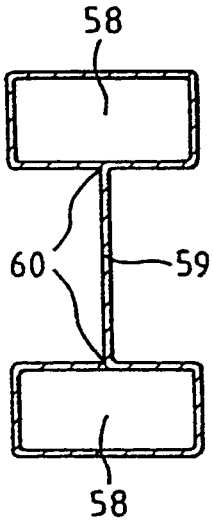
Figure 32:
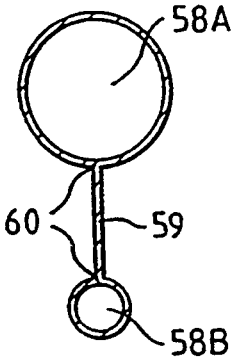
Figure 33:
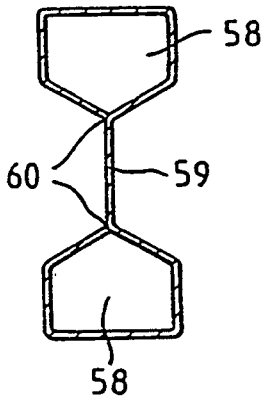
Figure 34:
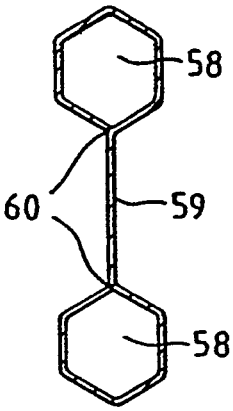
Figure 35:
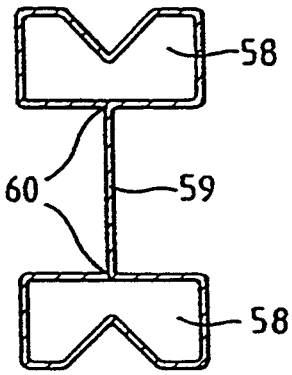

FIGS. 29–35 show various possible cross sectional profiles of structural members that may be obtained in accordance with the invention. FIG. 29 shows a preferred structural member having hollow triangular end sections 58 and web 59. Two weld joins 60 between end sections 58 and web 59 are also shown. For the sake of convenience similar reference numerals have been utilized in regard to the remainder of the structural members shown in FIGS. 30–35. Differently sized hollow-end sections 58A and 58B may be obtained in accordance with the invention as shown in FIG. 32. There also may be provided grooves 61 as shown in FIG. 35 if desired.

From the foregoing it therefore can be appreciated that structural members produced in accordance with the invention have a number of advantages when compared to the prior art. In this regard the structural member of the present invention combines the traditional advantages of cold formed hollow sections with a basic shape which is relatively efficient in resisting bending moment.

Therefore advantages attributable to the present invention when compared to conventional or solid structural members include the following:

(i) minimum thickness of sections not limited by a hot rolling process in being preferably formed by cold rolling;

(ii) cold-rolling of strip during forming enhances yield;

(iii) removal of mill scale and rust during forming may be carried out; and (iv) prime-painting during manufacture may also be carried out.

The basic shape of the structural members of the invention also will be relatively efficient for the following reasons:

(a) the section consists of two hollow flanges or end sections connected by a single web;

(b) the structural members of the invention are thus similar to traditional universal beams which have two parallel flanges and single flat web with flanges substantially thicker than the web;

(c) a single web is much more efficient that two webs as in traditional cold-formed hollow sections;

(d) because the flanges are hollow the flanges are effectively much thicker than the web. This is much more efficient than having equal flange and web thicknesses;

(e) flange widths to thickness ratios are also less limited by local buckling and web buckling considerations than is the case with traditional universal beams;

(f) web widths to thickness ratios are effectively reduced by the width of the hollow section flanges which in turn reduces the effect of web buckling considerations on load beam capacity;

(g) because of these benefits in local buckling and web buckling considerations, higher yield strength steels can be used to provide significant economic advantages; and (h) low exposed surface area to mass and strength ratios are obtained which assists in reducing costs for both corrosion protection and fire-proofing.

It should be noted that these advantages are inherently related to the ability to produce a welded hollow section with two weld joins. An open section of similar shape, i.e. a section where the ends of the strip are not welded to the web to form two closed hollow sections, would have markedly reduced load capacities due to local buckling considerations. This is clearly applicable to the prior art referred to previously, i.e. U.S. Pat. No. 3,342,007 and U.S. Pat. No. 3,517,474.

As previously discussed it would also be possible to utilize the space inside the hollow end sections to provide for pre-stressing of the structural members by the installation of pre-tensioning members within the hollow end sections.

The preferred section is formed from a single unitary piece which is welded at two separate locations to form a basic shape of two separate circles connected by a single web. This basic shape consisting of two separate circles connected by a single web can then be shaped into a myriad of final section shapes.

Two preferred final shapes are the symmetrical triangular shape which equates to the current range of universal beams and a further symmetrical triangular shape which equates to the current range of hot-rolled channels.

As previously discussed it would also be possible to utilize the space inside the hollow end sections to provide for pre-stressing of the structural members by the installation of pre-tensioning members within the hollow end sections.

Following pre-tensioning it is possible to fill the hollow end section with grout. Filing with grout in this instance can be used to improve the resistance to load under fire and help prevent the pre-tensioning members from corrosion.

Figure 36:
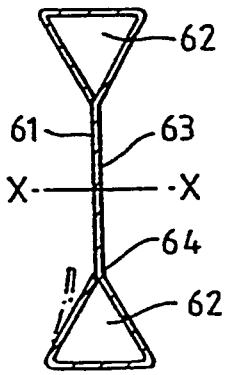
FIG. 36 illustrates a beam in accordance with the aforementioned Merson specification which is subject to local buckling.
Figure 37:
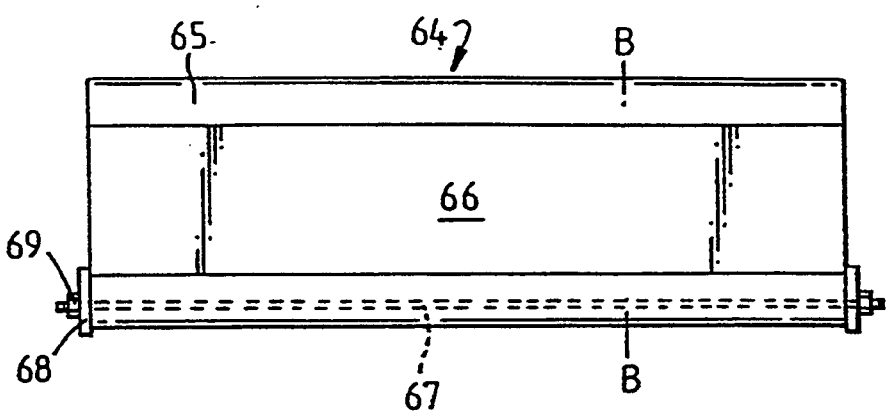
Figure 38:
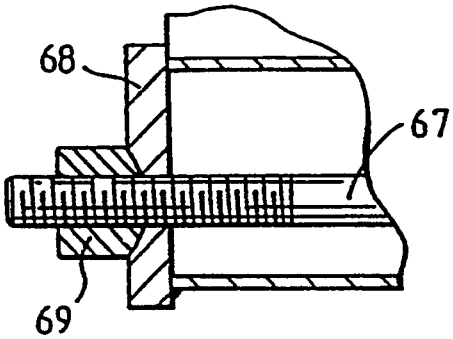
Figure 39:
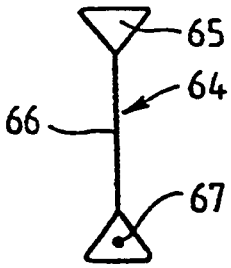

FIG. 36 illustrates a beam in accordance with the aforementioned Merson specification which is subject to local buckling;

FIGS. 37, 38 and 39 illustrate a structural member of the invention prestressed by appropriate means, wherein FIG. 38 is a section along line B—B of FIG. 37.

In FIGS. 37–39 the structural member 64 of the invention has hollowed sections 65 and intermediate web 66. Pre-stressing member 67 is shown attached to structural member 64 by bearing end plates 68 and spherical nut 69.

I claim:

1. An elongate structural member formed from a single strip of metal by a continuous cold rolling process, the structural member comprising:

an intermediate web member and hollow flanges extending longitudinally of the intermediate web member; characterized in that the hollow flanges are of a predetermined shape and are formed by successively deforming free edge portions of a planar strip of metal in a roll forming mill in a continuous operation followed by continuous seam welding of the respective free edges of the shaped hollow flange portions to the surface of the intermediate web member adjacent the junction of the web member and respective hollow flange portions; and the free edges of the hollow flange portions are welded to the surface of the intermediate web member by high frequency electrical induction or resistance welding.

2. A structural member as claimed in claim 1 wherein the hollow flanges are of different cross-sectional shapes.

3. A structural member as claimed in claim 1 wherein the hollow flanges are of different cross-sectional areas.

4. A structural member as claimed in claim 1 wherein at least one hollow flange has a symmetrical triangular cross-sectional shape.

5. A structural member as claimed in claim 4 wherein both hollow flanges have a symmetrical triangular cross-sectional shape of substantially the same cross-sectional area.

6. A structural member as claimed in claim 1 wherein at least one hollow flange has a circular cross-sectional shape.

7. A structural member as claimed in claim 1 wherein the free edges of the hollow flange portions are welded substantially perpendicular to the surface of the intermediate web.

8. A structural member as claimed in claim 7 in which the hollow flange portions have been roll-formed to their final shape after being welded to the intermediate web member.

9. A structural member as claimed in claim 1 further comprising a prestressing member extending longitudinally through one of the hollow flanges.

* * * * *